United States Patent [19]

Stease et al.

[11] Patent Number: 4,993,625

[45] Date of Patent: Feb. 19, 1991

[54] TRAY

[75] Inventors: Ralph E. Stease; Kevin A. Gorsuch, both of Cincinnati, Ohio

[73] Assignee: Honeymoon Paper Products, Ohio

[21] Appl. No.: 504,615

[22] Filed: Apr. 4, 1990

[51] Int. Cl.[5] ..... B65D 5/20

[52] U.S. Cl. ..... 229/109; 206/557; 229/163; 229/906

[58] Field of Search ..... 229/109, 163, 906, 188; 206/303, 557

[56] References Cited

U.S. PATENT DOCUMENTS

| | | | |
|---|---|---|---|
| 285,456 | 9/1883 | Brehmer . | |
| 1,052,564 | 2/1913 | Brown . | |
| 1,623,715 | 4/1927 | Berkowitz | 229/109 |
| 1,767,733 | 6/1930 | Brown . | |
| 1,960,635 | 5/1934 | Kinkenon . | |
| 2,147,563 | 2/1939 | Turner . | |
| 2,295,478 | 9/1942 | Jason, Jr. | 229/163 |
| 2,372,312 | 3/1945 | Buttery | 229/109 |
| 2,646,916 | 7/1953 | Meller . | |
| 2,663,488 | 12/1953 | Gibbons . | |
| 2,749,018 | 6/1956 | Berke | 229/109 |
| 2,784,900 | 3/1957 | Bauer . | |
| 2,819,833 | 1/1958 | Sauer . | |
| 3,165,253 | 1/1965 | Adams et al. . | |
| 3,343,744 | 9/1967 | Morell et al. . | |
| 3,512,697 | 5/1970 | Robinson . | |
| 3,923,234 | 12/1975 | Lund, Jr. | 229/109 |
| 4,362,265 | 12/1982 | Williams . | |
| 4,765,534 | 8/1988 | Zion et al. . | |
| 4,913,340 | 4/1990 | Ilitch | 229/906 |
| 4,919,326 | 4/1990 | Deiger | 229/109 |

FOREIGN PATENT DOCUMENTS

| | | | |
|---|---|---|---|
| 3218174 | 11/1983 | Fed. Rep. of Germany | 229/109 |
| 1320926 | 2/1963 | France . | |
| 2329523 | 5/1977 | France . | |
| 2408525 | 6/1979 | France . | |
| 2018226 | 10/1979 | United Kingdom . | |
| 2116150 | 9/1980 | United Kingdom . | |
| 1604883 | 12/1981 | United Kingdom | 229/188 |

*Primary Examiner*—Gary E. Elkins

*Attorney, Agent, or Firm*—Wood, Herron & Evans

[57] ABSTRACT

A tray which, in one preferred form, may be sized to hold a flat food product such as a pizza. The tray, in this one preferred form, includes a pair of opposed side walls each being foldably connected along a base edge at a generally right angle to a floor. A corner wall is foldably connected to each end of each side wall and also is oriented at a generally right angle to the floor, each corner wall also being oriented at an angle relative to its connected side wall. A set up panel is foldably connected to a bottom edge of each corner panel, is foldably connected to the floor, and overlies the floor in flush relation when the associated corner panel is oriented at a general right angle relative to the floor. A fastener system directly connects each set up panel with the floor. When each set up panel is so fastened to the floor, the side walls and the corner walls are retained in generally upright, i.e., right angular, position relative to the floor, thereby forming a tray with opposed side and corner wall pairs that cooperate to retain a product, e.g., a pizza, therebetween on the floor even when the tray is somewhat tipped relative to horizontal.

32 Claims, 4 Drawing Sheets

TRAY

This invention relates to containers. More particularly, this invention relates to a tray which, in one preferred form, is sized to hold a flat food product such as a pizza.

The most common way of packaging pizza for carryout in the pizza business today is to place the pizza on the floor of a carton. The carton, of course, has a cover, and the cover is closed after the pizza is placed on the floor so that the retail consumer can take the pizza home. There are a couple of disadvantages to this packaging approach for carryout pizza. First, the cartons are normally delivered to carryout restaurants in knockdown or blank configuration. A restaurant employee must then erect each carton from a supply of the blanks, and this is a relatively time consuming operation because the blank may require numerous folding and fastening steps. Second, the erected carton is comprised of side walls that extend circumferentially around its entire periphery. This means that when the consumer gets the pizza home, the pizza must be lifted out of the carton before it can be easily cut or re-cut. In other words, a pizza knife cannot be drawn through the pizza beyond the edges of the carton's floor while the pizza remains in the carton because the carton's walls prevent the knife from being so used. This peripheral wall aspect of prior art cartons also makes initial loading of the pizza into the carton somewhat difficult because of limited spacing between the carton's side walls and the pizza pie's circumference when it is hand set into the carton. And third, the prior art closed carton, which is commonly made of corrugated board, requires a substantial amount of such board in light of the fact that carton has side walls around the entire periphery of the carton's floor, and also includes a lid used to close the carton.

Accordingly, it has been the primary objective of this invention to provide a tray which does not require side walls around its entire periphery, and which makes use of no lid, thereby obviating the above discussed problems relative to prior art cartons of the type as described above. In accord with this objective, and in one preferred form, the tray of this invention may be sized to hold relatively flat food products such as pizza, pie or cake. Alternatively, and in other preferred forms, the tray of this invention may be sized to hold diverse products such as coiled rope or wire, stacked disks, and round fluorescent bulbs.

The tray, in preferred form, includes a pair of opposed side walls each being foldably connected along a base edge at a generally right angle to a floor. A corner wall is foldably connected to each end of each side wall and also is oriented at a generally right angle to the floor, each corner wall also being oriented at an angle relative to its connected side wall. A set up panel is foldably connected to a bottom edge of each corner panel, is foldably connected to the floor, and overlies the floor in flush relation when the associated corner panel is oriented at a generally right angle relative to the floor. A fastener system directly connects each set up panel with the floor. When each set up panel is so fastened to the floor, the side walls and the corner walls are retained in generally upright, i.e., right angular, position relative to the floor, thereby forming a tray with opposed side and corner wall pairs that cooperate to retain a product, e.g., a flat food product therebetween on the floor even when the tray is somewhat tipped relative to horizontal.

Other objectives and advantages of this invention will be more apparent from the following detailed description taken in conjunction with the drawings in which.

Figure 1:
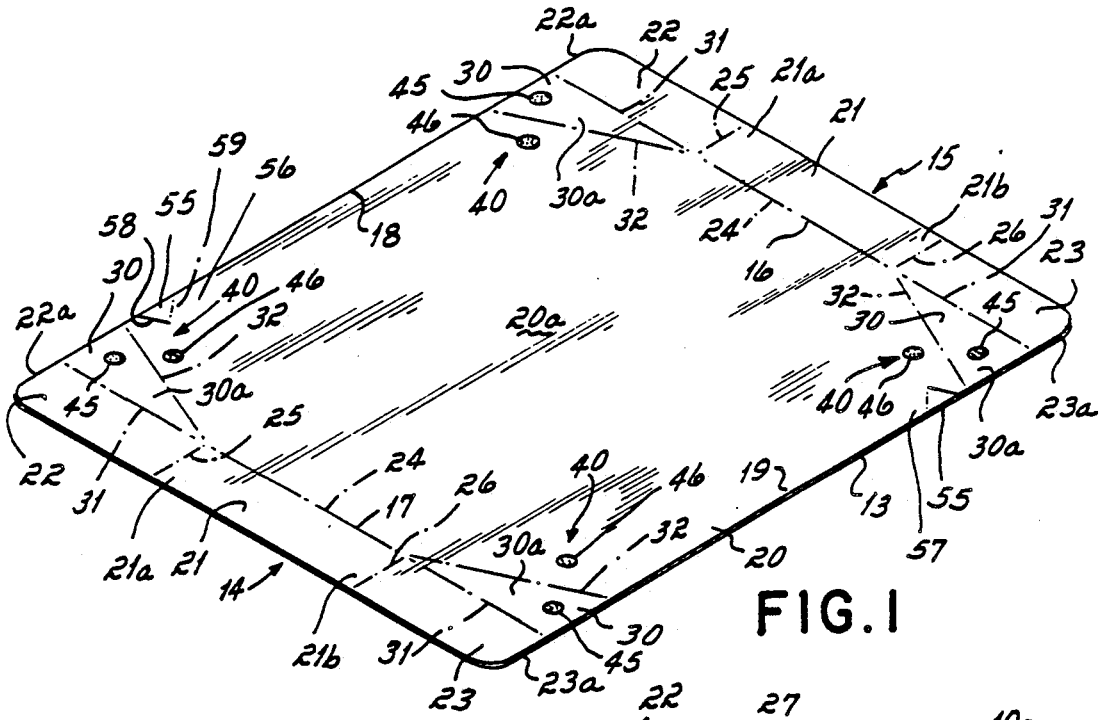
FIG. 1 is a perspective view of a first embodiment of a blank for a shallow tray in accord with the principles of this invention, same illustrating a first embodiment of a fastener system for fastening the tray's set up panels to the tray's floor, the tray being sized to hold a flat food product such as a pizza.
Figure 2:
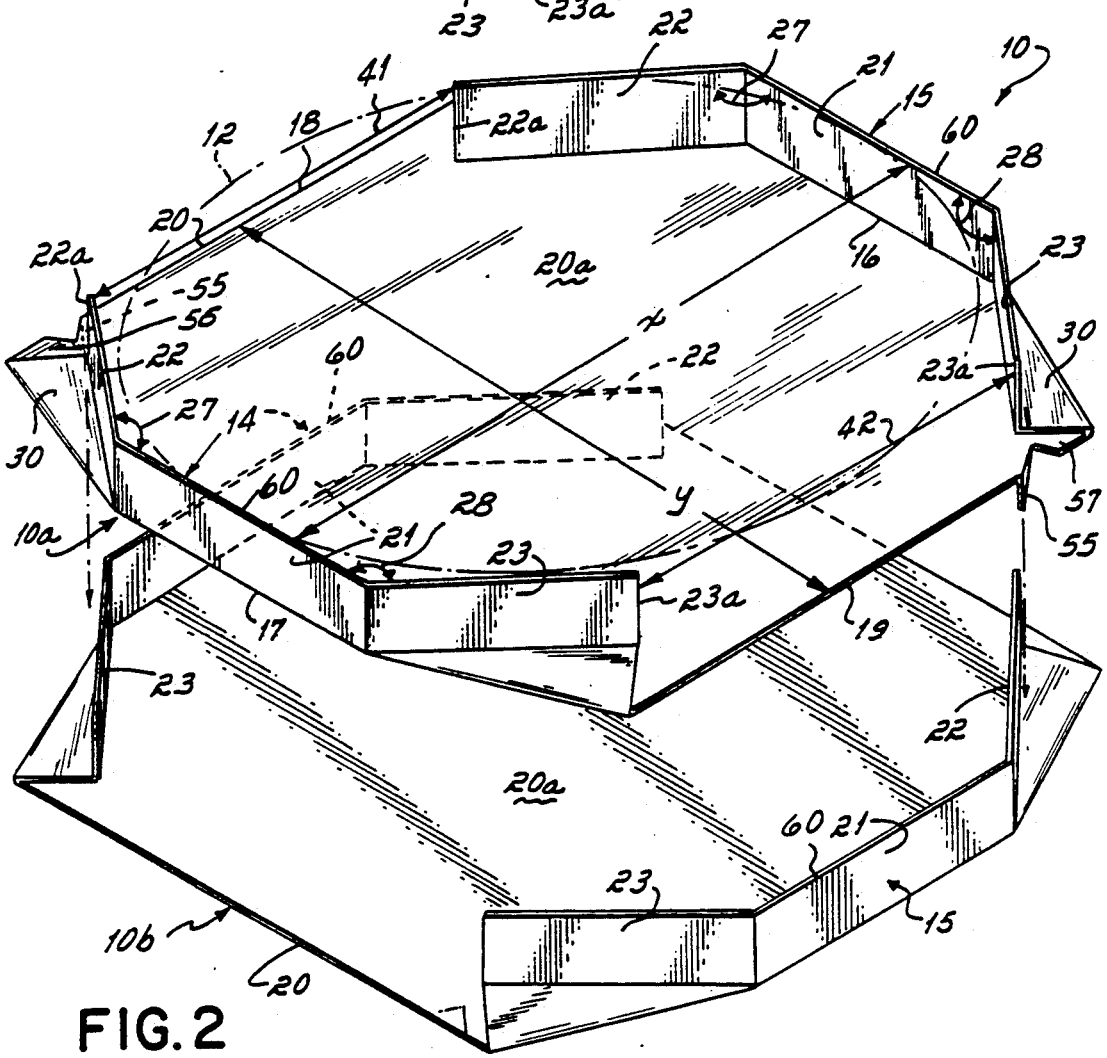
FIG. 2 is a perspective view of two shallow trays, each being erected from a blank of the type illustrated in FIG. 1, same being illustrated in prospective stacked relation.

A first embodiment of a shallow tray 10 in accord with the principles of this invention is illustrated particularly in FIGS. 1 and 2. The shallow tray shown in FIG. 2 is erected from the tray blank 11 illustrated in FIG. 1. The erected tray 10 defines a generally circular (see phantom line 12) constraint that may be particularly sized to hold any flat food product such as pizza, pies, cakes and the like. More particularly, the tray blank 11 illustrated in FIG. 1 is of a generally rectangular configuration along its outer circumferential periphery 13. With the opposed side wall structure 14, 15 erected, however, the erected tray 10 defines the circular interior periphery 12 where cross dimension x is substantially the same as cross dimension y.

The tray blank 11, as shown in FIG. 1, is comprised of a floor 20, and the opposed side wall structures 14, 15 each foldably connected to the floor 20. The side wall structures 14, 15 are thus foldably connected to a first pair of opposed side edges 16, 17 of the floor 20. Note particularly that no side wall structure, i.e., no wall structure analogous to opposed side wall structures 14, 15, is provided along a second pair of opposed side edges 18, 19 of the floor 20. Each side wall structure 14, 15 includes a side wall 21 connected to the floor 20 on fold line 24 (which also constitutes a side edge 16 or 17 of the floor). Each side wall structure 14, 15 further includes two corner walls 22, 23. The corner wall 22 is connected on fold line 25 (which also constitutes one end edge of the side wall 21) to one end 21*a* of the side wall, and the corner wall 23 is connected on fold line 26 (which constitutes the other end edge of the side wall 21) to the other end 21*b* of that side wall. Note the fold lines 25, 26 by which the corner walls 22, 23 are separated from the associated side wall 21 are normal to the floor's side wall edge 16 or 17 when the tray is in the blank 11 configuration as well as when it is in the set up 10 configuration. Therefor, each corner wall 22, 23 and each side wall 21 are oriented at a generally right angle relative to the floor 20 when the tray 10 is erected as illustrated in FIG. 2. Note also as illustrated in FIG. 2, that each corner wall 22, 23 of each side wall structure 14, 15 is also oriented in such a way as to define an interior obtuse angle 27, 28 relative to that side wall to which it is connected when the tray 10 is erected.

A set up panel 30 is connected to a bottom edge of each corner wall 22, 23 along fold line 31. Each set up panel 30 also is connected along fold line 32 to the floor 20. Each set up panel 30 is of generally triangular configuration with that triangular configuration being preferably of a right angular triangle configuration as illustrated where the right angle is partially defined by the bottom edge 31 of the adjacent corner wall 22 or 23 and by the adjacent free edge 18 or 19 of the floor 20. When erected, each set up panel 30 overlies the floor 20 in flush relation therewith as particularly shown in FIG. 2, the top surface 30*a* of the set up panel being in face to face relation with the top surface 20*a* of the floor when compared in FIG. 1 configuration with FIG. 2 set up configuration. And as to each side wall structure 14, 15, note particularly that folding of the two set up panels 30 associated with each side wall 21 causes that side wall and the two corner walls 22, 23 to fold upwardly along fold lines 16, 31 until those side and corner walls are oriented at a generally right angular configuration relative to the floor 20 as illustrated in FIG. 2.

A fastener system 40 directly connects each set up panel 30 with the floor 20, thereby functioning to retain each side wall structure 14, 15 in generally right angular erected position relative to the floor. This fastener system 40 thereby allows the opposed side walls 21, and each opposed side wall's associated corner walls 22, 23, to form a shallow tray 10 with an opposed pair of side wall structures 14, 15 that cooperate to retain a flat food product such as a pizza (not shown) therebetween on the floor 20 even when the tray is somewhat tipped relative to the horizontal. Note particularly, as shown in FIG. 2, that in the erected tray 10 configuration each corner wall 22, 23 has a free end edge 22*a*, 23*a*. The free end edges 22*a*, 23*a* of each pair of opposed corner walls 22 or 23 of the opposed side wall structures 14, 15 are spaced one from the other so as to create opposed gaps 41, 42 oriented at generally right angles relative to the opposed side walls 21. With a flat food product such as a pizza (not shown) disposed on the tray 10, same can be relatively easily cut by a cutting implement such as a knife which can be drawn through those gaps 41, 42 while the pizza is retained on the tray between the opposed side wall structures 14, 15. Further, pizza sections (not shown) of the pizza (not shown) as cut on the tray's floor 20 can be a little more easily removed from the tray than from a carton with side walls extending circumferentially therearound simply by drawing the pizza sections out through the gaps 41, 42 instead of lifting same out of the carton.

A couple of different embodiments of the fastener system 40 that directly connects each set up panel 30 with the tray's floor 20 can be used. A first fastener system embodiment is illustrated in FIG. 1. In this first embodiment, a glue dot 45 is carried on top face 30*a* of each set up panel 30, and a mating glue dot 46 is carried on the tray floor's top face 20*a* adjacent thereto. When the set up panel 30 is erected relative to the floor 20, the two glue dots 45, 46 join one with the other so as to retain the set up panel in erected configuration with the floor as shown in FIG. 2. Preferably a self adhering glue is used for both glue dots 45, 46, the glue being of the type which adheres only to itself, i.e., which will not adhere to cardboard stacked on top of it. With these preferred self adhering glue dots 45, 46, a whole stack of tray blanks 11 can be stacked one on top the other without need for cover paper for the glue dots.

Figure 3:
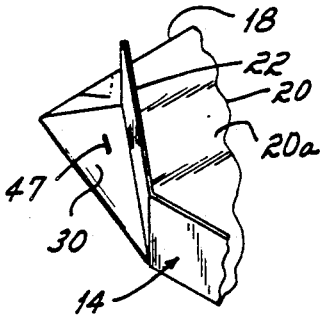
FIG. 3 is a perspective view of a second embodiment of a fastener system for fastening the tray's set up panels to the tray's floor.
Figure 4:
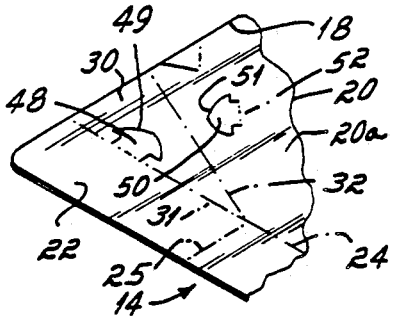
FIG. 4 is a perspective view of a third embodiment of a fastener system for fastening the tray's set up panels to the tray's floor, the system being shown with the tray in the blank configuration.
Figure 5:
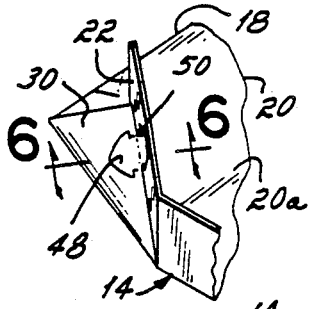
FIG. 5 is a view similar to FIG. 3 but illustrating the third embodiment of the fastener system with the tray in the erected configuration.
Figure 6:
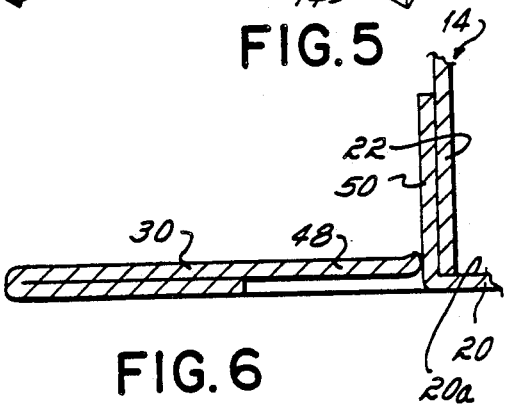
FIG. 6 is a cross-sectional view taken along line 6—6 of FIG. 5.

A second fastener system embodiment is illustrated in FIG. 3. This second fastener system 40 embodiment simply is in the form of a staple 47 partially carried by the set up panel 30 and partially carried by that area of the floor 20 which underlies the set up panel. The staple 47 can be simply installed by a stapler of any well known type once the side wall structure 14, 15 has been erected as shown in FIG. 3. A third embodiment of the fastener system 40 is illustrated in FIGS. 4–6. In this third embodiment, and when the tray 10 is in the blank configuration as shown in FIG. 4, a first T-shaped tab 48 is defined in each set up panel 30 by cut lines 49 adjacent the fold line 31 that separates the set up panel and the corner panel wall 22 or 23, and a second T-shaped tab 50 is defined in the floor 20 by cut line 51 and fold line 52, the second tab being adjacent the fold line 32 that separates the set up panel and the floor. As shown in FIGS. 5 and 6, when a corner wall 22 or 23 is erected relative to the floor 20, the floor's tab 50 is upraised against the outside face of the corner panel after the set up panel's tab 48 has been deflected out of the way, and the set up panel's tab is thereafter re-set into co-planar relation with the set up panel as illustrated in FIG. 6, so as to hold the floor panel's tab against the corner wall's outside face.

Figure 10:
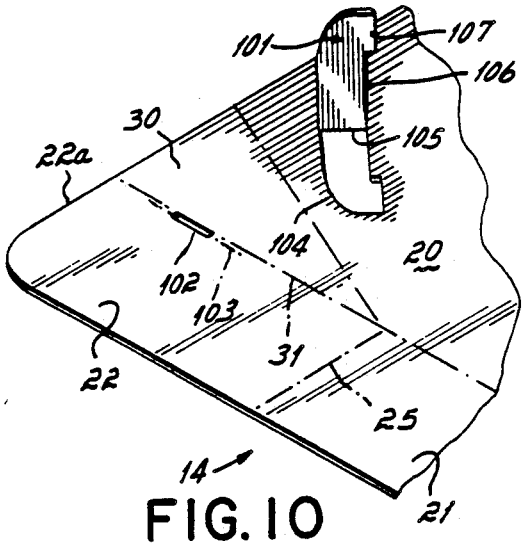
FIG. 10 is a view similar to FIG. 9 illustrating a first intermediate step in use of the fourth embodiment.
Figure 11:
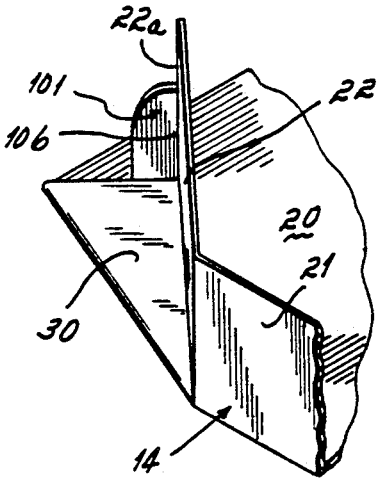
FIG. 11 is a view similar to FIG. 10 illustrating a second intermediate step in use of the fourth embodiment.
Figure 12:
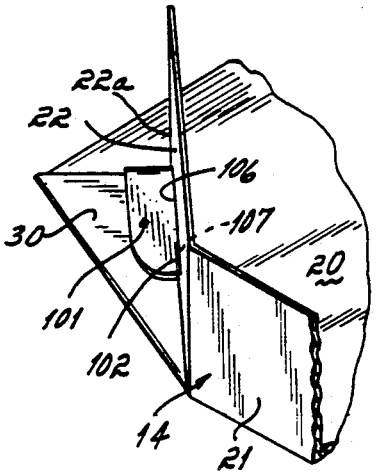
FIG. 12 is a view similar to FIG. 11 illustrating the fourth embodiment of the fastener system with the tray in the erected configuration.

A fourth alternative embodiment for the fastener system 40 in accord with the principles of this invention is illustrated in FIGS. 9–12. The fastener system 40 includes a latch finger 101 cut out of the tray's floor 20 that cooperates with a slot 102 cut out of the corner wall 22 or 23 at each corner of the tray. More specifically, the slot 102 is juxtaposed to that fold line 31 which separates the corner wall 22 or 23 and the set up panel 30. One edge of the slot 102 is defined by that fold line 31, and the slot's longitudinal axis 103 is parallel to that fold line. Accordingly, and when the set up panels 30 for each side wall structure 14 or 15 are erected so as to orient the side 21 and corner 22, 23 walls normal to the tray's floor 20, the slot is automatically oriented in a vertical plane since it is cut out of the corner wall 22 or 23. The latch finger 101 is defined by cut lines 104 and fold line 105 on the tray's floor 20. Note particularly the fold line 105 is oriented generally perpendicular to that fold line 31 which separates the set up panel 30 and the corner wall 22 or 23 when the corner wall is oriented in erected configuration as shown in FIG. 11. The latch finger 101 defines a base edge 106 parallel to and juxtaposed to the fold line 31 that separates the set up panel 30 and the corner wall 22 or 23 when the tray is erected. A tab 107 adapted to interfit with the slot 102 extends beyond that base edge 106. Note also the latch finger's fold line 105 is juxtaposed to the free edge 22*a* or 23*a* of the corner wall 22 or 23 when that corner wall is erected, see FIG. 12. In use of each latch finger 101, the latch finger is initially popped upwardly above the tray's floor 20 before the side wall structure is erected as shown in FIG. 10. Thereafter, the set up panels 30 are uplifted to erect the side 21 and corner 22, 23 walls as shown in FIG. 11. Subsequently, the latch finger 101 is pivoted down into overlying relationship onto the top surface of the set up panel 30 at which location the finger's tab 107 extends into the corner wall's slot 102. This provides a fastener system 40 that maintains structural integrity of the erected tray 10. And it also ensures that nothing protrudes below the bottom surface of the tray's floor 20 so as to impede insertion of the tray with, e.g., a pizza, into a bag (not shown) for retail take out use.

An additional feature of the first embodiment of the tray 10 is also illustrated in FIGS. 1 and 2. As shown in the tray blank 11 configuration illustrated in FIG. 1, the opposed side edges 18, 19 of the tray blank 11 that are not foldably connected with the side wall structure 14, 15, i.e., the free side edges 18, 19, each define a notch panel 55 adjacent diagonally opposite corners 56, 57 of the floor 20. Each triangular notch panel 55 is defined by a cut line 58, and is connected to the floor by a fold line 59. When it is desired to stack an upper erected tray 10*a* on top a lower erected tray 10*b*, as illustrated in FIG. 2, the notch panels 55 of the upper tray are deflected downwardly beneath the floor into a generally vertical position, same being so deflectable along fold lines 59. With the upper tray's notch panels 55 so deflected, the upper tray 10*a* is rotated 90° relative to the lower tray 10*b*, and the upper tray then simply lowered into nesting relation with the lower tray. When so oriented and nested, the notch panels 55 of the upper tray 10*a* are located in substantially facial relation with corner walls 22, 23 of the lower tray with the upper tray's floor 20 being seated on the top edges 60 of the lower tray's wall structures 14, 15. These notch panels 55 of the upper tray 10*a* thereby cooperate with the lower tray 10*b* in order to aid in maintaining the upper and lower trays in stacked relation when same are being carried.

In use, and with a pizza (not shown) installed on an erected tray 10 of the type shown in FIG. 2, the tray can simply be slipped inside a shallow height bag (not shown) for delivery to a retail customer. This combination bag and tray 10 packaging system, in the first place, is significantly less expensive than an enclosed carton. And in the second place, at the retail pizza outlet level the shallow tray 10 can be more easily and quickly erected from the flat blank 11 configuration illustrated in FIG. 1 than a carton with cover can be erected, thereby minimizing labor for the pizza restaurant owner, and also the cost of supplies for the pizza restaurant owner, relative to the closed carton packaging system.

Figure 7:
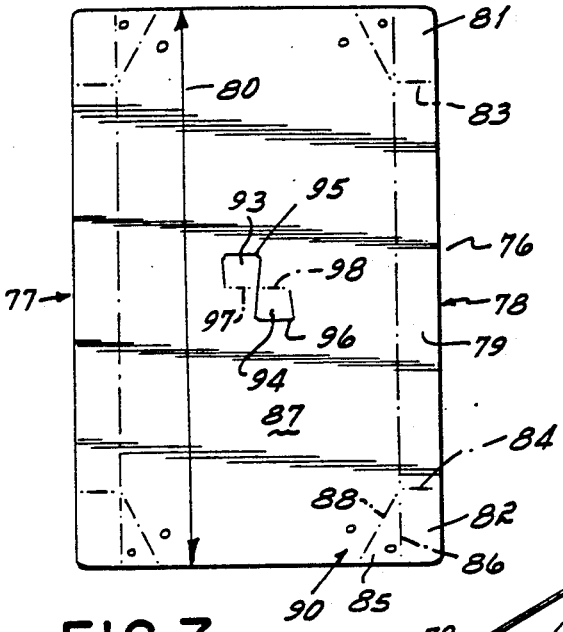
FIG. 7 is a top plan view of a second embodiment of a blank for a shallow tray in accord with the principles of this invention.
Figure 8:
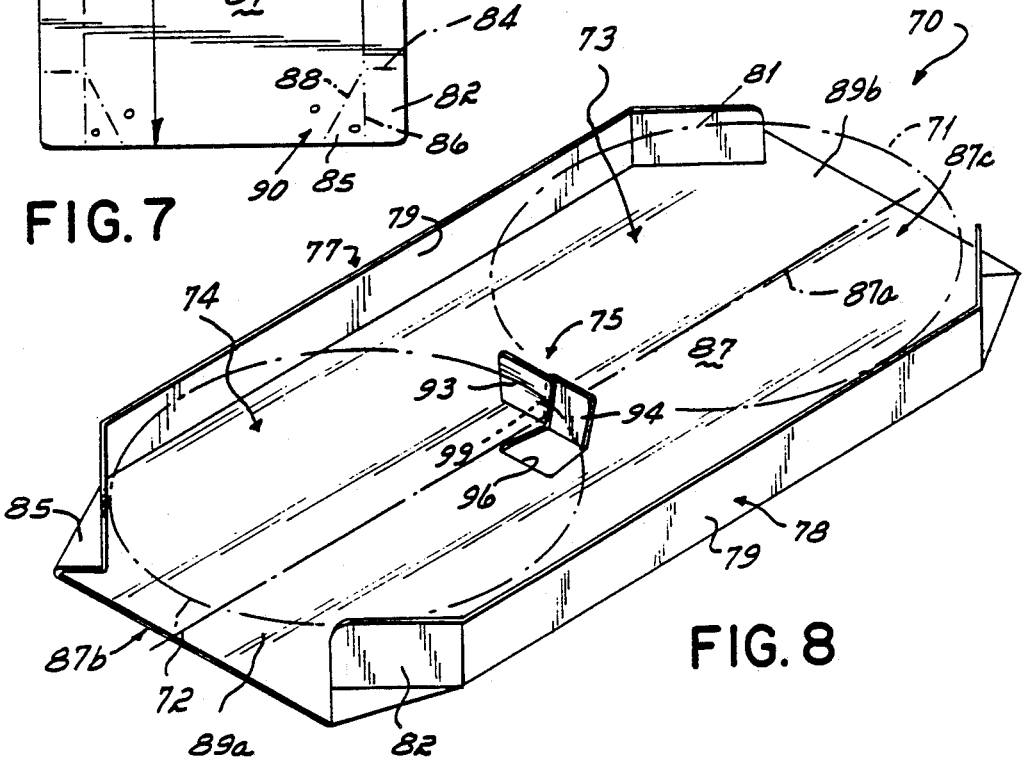
FIG. 8 is a perspective view of a tray erected from the blank illustrated in FIG. 7.
Figure 9:
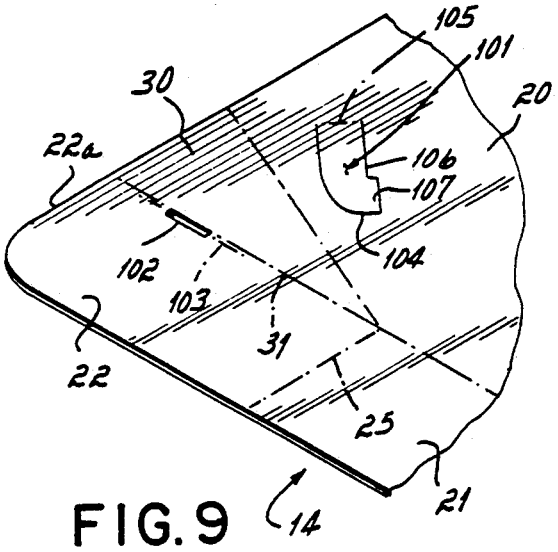
FIG. 9 is a perspective view of a fourth embodiment of a fastener system for fastening the tray's set up panels to the tray's floor, the system being shown with the tray in the blank configuration.

A second embodiment of a shallow tray 70 in accord with the principles of this invention is illustrated in FIGS. 7 and 8. The erected tray 70 illustrated in FIG. 8 is sized to retain two separate pizzas (not shown) on a floor 87 in circular areas illustrated by phantom lines 71, 72. The tray 70 is sub-divided into two tray sections 73, 74 by divider panel structure 75. As shown in FIG. 7, the tray blank 76 includes a pair of opposed side wall structures 77, 78. Each side wall structure 77, 78 includes a side wall 79 the continuous length of which is somewhat more than twice as long as the length of the side wall 21 illustrated in the FIGS. 1 and 2 embodiment because the tray is sized lengthwise 80 to retain two pizzas of generally circular configuration within the two tray sections 73, 74. The opposed side walls 79 are oriented generally parallel to the longitudinal axis 87*a* of the floor 87 so that each extends between opposed ends 87*b*, 87*c* of the floor where gaps 89*a*, 89*b* are defined. Each of these opposed side walls 79 is provided with a corner wall 81, 82 foldably connected along fold line 83, 84, respectively, at each end. The two corner walls 81, 82 associated with each side wall 79 are each provided with a set up panel 85 connected to a bottom edge of its associated corner wall by a fold line 86, and connected to floor 87 along fold line 88, so that the side wall structures 77, 78 can be erected in the same fashion as with the FIGS. 1 and 2 embodiment earlier described. The fastener system 90 illustrated in this second embodiment to hold the side wall structure in erected configuration is the same glue dot 45, 46 system described in connection with the FIGS. 1 and 2 embodiment.

Note particularly, as shown in FIGS. 7 and 8, that divider panel structure 75 includes first 93 and second 94 divider panel sections cut out of the floor 87. These divider panel sections 93, 94 are cut out of the floor along cut lines 95, 96, respectively, and the divider panel sections are connected to the floor along co-axial fold lines 97, 98 that serve as a hinge line for both panel sections. One 93 of the panel sections is cut from the floor 87 on one side of the fold axis 97, 98 and the other 94 of the panel sections is cut from the floor on the opposite side of the fold axis. And note also the two panel sections 93, 94 are configured to overlap one another, as at 99, when oriented at generally right angles relative to the floor as shown in FIG. 8. The memory of the corrugated board from which the tray 70 is configured, when the two panel sections 93, 94 are overlapped relative one to the other as shown in FIG. 8, cause those sections to be retained in the vertically upright configuration relative to the floor 87. Thus, these divider panel sections 93, 94 function to retain one of the flat food products separate from the other of the flat food products on the double tray 70.

Figures 13, 14:
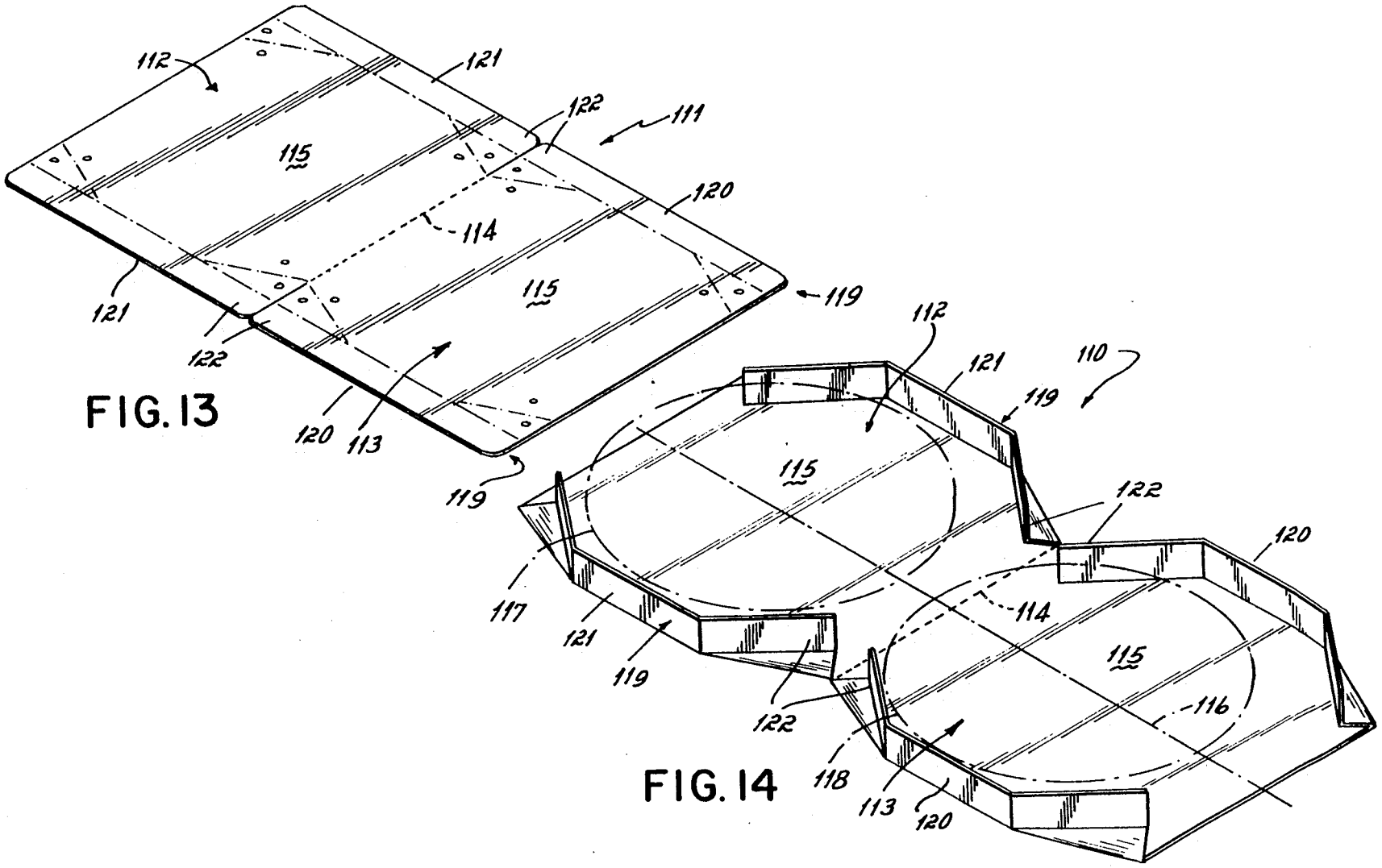
FIG. 13 is a top plan view of a third embodiment of a blank for a shallow tray in accord with the principles of this invention.
FIG. 14 is a perspective view of a tray erected from the blank illustrated in FIG. 13.

A third embodiment of a shallow tray 110 and a shallow tray blank 111 in accord with the principles of this invention is illustrated in FIGS. 13 and 14. The tray 100 is sub-divided into two tray sections 112, 113 by a separator strip 114 in the form of a line of perforation defined in the tray floor 115. The separator strip 114 may also be in the form of a tear strip (not shown) or drawstring (not shown) if desired. Each of the tray's sections 112, 113 is sized to hold one product, e.g., one pizza. The separator strip 114 is oriented generally normal to the longitudinal axis 116 of the floor, and it permits the tray to be separated into two separate sections 112, 113 if desired. In other words, the erected tray 100 illustrated in FIG. 14 is sized to retain two separate pizzas (not shown) on floor 115 in circular areas illustrated by phantom lines 117 and 118. If desired, the erected tray 110 can be used to carry the two pizzas, or the two tray sections 112, 113 can be separated along the line of perforation 114 simply by tearing the two sections apart one from the other so that two separate trays of the type illustrated in FIGS. 1 and 2 result.

More particularly, each side wall 119 of the tray 110 is comprised of two side wall sections 120, 121, each side wall section having a corner wall 122 foldably connected to each end thereof. One of each side wall section 120, 121 and associated corner walls 122 is located on opposite sides of the separator strip 114. Accordingly, the erected tray 110 that results from the tray blank 111 is basically two trays of the FIGS. 1 and 2 type which are connected together along an adjacent open gap edge by the line of perforation 114.

Having described in detail the preferred embodiments of our invention, what we desire to claim and protect by Letters Patent is:

1. A tray comprising a floor, a pair of opposed side walls each being oriented at a generally right angle relative to said floor, each of said side walls being foldably connected along a base edge to said floor, a corner wall foldably connected to each end edge of each side wall, each corner wall being oriented at a generally right angle relative to said floor, each corner wall also being oriented at an angle relative to its connected side wall, a set up panel foldably connected to a bottom edge of each corner wall, said set up panel also being foldably connected to said floor, said set up panel overlying said floor panel in flush relation when its associated corner panel is oriented at a generally right angle relative to said floor, and a fastener system that directly connects each set up panel with said floor, said fastener system functioning to retain said side walls and said corner walls in generally right angular position relative to said floor, thereby forming a tray with opposed side and corner wall pairs that cooperate to retain a product therebetween on said floor even when said tray is somewhat tipped relative to horizontal.

2. A tray as claimed in claim 1, each corner wall having a free end edge, the free end edges of each pair of opposed corner walls being spaced one from the other so as to create opposed gaps oriented at generally right angles relative to said side walls.

3. A tray as claimed in claim 1, said fastener system comprising a glue dot carried on at least one of the underside of a set up panel and that area of said floor which underlies said set up panel.

4. A tray as set forth in claim 1, said fastener system comprising a staple partially carried by a set up panel and partially carried by that area of said floor which underlies said set up panel.

5. A tray as set forth in claim 1, said fastener system comprising a tab cut out of one of a set up panel and that area of said floor which underlies said set up panel, said tab cooperating with that one of said set up panel and said floor area from which it was not cut.

6. A tray as set forth in claim 1, said fastener system comprising a latch finger cut out of said floor adjacent a set up panel, said latch finger overlying said set up panel.

7. A tray as set forth in claim 6, said fastener system comprising a tab connected to said latch finger, said tab being received in a slot found in an adjacent corner wall.

8. A tray as set forth in claim 1, said floor being sized to hold two products in side by side relation, said opposed side walls being oriented generally parallel to the longitudinal axis of said floor.

9. A tray as claimed in claim 8, each corner wall having a free end edge, the free end edges of each pair of opposed corner walls being spaced one from the other so as to create opposed gaps oriented at generally right angles relative to said side walls, said opposed gaps thereby being located at opposed ends of said floor.

10. A tray as set forth in claim 8, said floor comprising a separator strip oriented generally normal to the longitudinal axis of said floor, said strip permitting said floor, and therefor said tray, to be separated into two separate sections if desired.

11. A tray as set forth in claim 10, said separator strip being in the form of a line of perforation in said floor, said strip being positioned generally midway between opposed ends of said tray.

12. A tray as set forth in claim 10, each side wall comprising two side wall sections, each side wall section having a corner wall foldably connected to each end edge thereof, each side wall section and associated corner walls of each side wall being located on opposite sides of said separator strip.

13. A tray as set forth in claim 8, said tray comprising a divider panel cut out of said floor, said divider panel being oriented at a generally right angle relative to said floor, said divider panel functioning to retain one of said products separate from the other of said products.

14. A tray as set forth in claim 13, said divider panel comprising first and second panel sections foldably connected to said floor on the same fold axis, one of said panel sections being cut from said floor on one side of said fold axis and the other of said panel sections being cut from said floor on the opposite side of said fold axis, said fold panels being configured to overlap one another when oriented at a generally right angle relative to said floor.

15. A tray as set forth in claim 8, each side wall being of a continuous length and extending between opposed ends of said floor.

16. A tray as set forth in claim 1, said tray comprising at least one notch panel that depends beneath said floor, said one notch panel being foldably connected to said floor, said notch panel of an upper tray cooperating with one of said walls of a lower tray in order to aid in maintaining said upper and lower trays in stacked relation.

17. A blank for a tray, said blank comprising a floor, a pair of opposed side walls each being orientable at a generally right angle relative to said floor, each of said side walls being foldably connected along a base edge to said floor, a corner wall foldably connected to each end edge of each side wall, each corner wall being orientable at a generally right angle relative to said floor, each corner wall also being orientable at an angle relative to its connected side wall, a set up panel foldably connected to a bottom edge of each corner wall, said set up panel also being foldably connected to said floor, said set up panel overlying said floor panel in flush relation when its associated corner panel is oriented at a generally right angle relative to said floor, and a fastener system that directly connects each set up panel with said floor when said tray is erected, said fastener system functioning to retain said side walls and said corner walls in generally right angular position relative to said floor when said tray is erected for forming a tray with opposed side and corner wall pairs that cooperate to retain a product therebetween on said floor even when said tray is somewhat tipped relative to horizontal.

18. A blank as claimed in claim 7, each corner wall having a free end edge, the free end edges of each pair of opposed corner walls being spaced one from the other so as to create opposed gaps oriented at generally right angles relative to said side walls when said tray is erected.

19. A blank as claimed in claim 17, said fastener system comprising a glue dot carried on at least one of the underside of a set up panel, and that area of said floor which underlies said set up panel, when tray is erected.

20. A blank as set forth in claim 17, said fastener system comprising a staple partially carried by a set up panel and partially carried by that area of said floor which underlies said set up panel when said tray is erected.

21. A blank as set forth in claim 17, said fastener system comprising a tab cut out of one of a set up panel and that area of said floor which underlies said set up panel when said tray is erected, said tab cooperating with that one of said set up panel and said floor area from which it was not cut when said tray is erected.

22. A blank as set forth in claim 17, said fastener system comprising a latch finger cut out of said floor adjacent a set up panel, said latch finger being adapted to overly said set up panel when said tray is erected.

23. A blank as set forth in claim 22, said fastener system comprising a tab connected to said latch finger, said tab being receivable in a slot found in an adjacent corner wall.

24. A blank as set forth in claim 17, said floor being sized to hold two products in side by side relation, said opposed side walls being oriented generally parallel to the longitudinal axis of said floor.

25. A blank as claimed in claim 24, each corner wall having a free end edge, the free end edges of each pair of opposed corner walls being spaced one from the other so as to create opposed gaps oriented at generally right angles relative to said side walls, said opposed gaps thereby being located at opposed ends of said floor.

26. A blank as set forth in claim 24, said floor comprising a separator strip oriented generally normal to the longitudinal axis of said floor, said strip permitting said floor, and therefor said tray, to be separated into two separate sections if desired.

27. A blank as set forth in claim 26, said separator strip being in the form of a line of perforation in said floor, said strip being positioned generally midway between opposed ends of said tray.

28. A blank as set forth in claim 26, each side wall comprising two side wall sections, each side wall section having a corner wall foldably connected to each end edge thereof, each side wall section and associated corner walls of each side wall being located on opposite sides of said separator strip.

29. A blank as set forth in claim 24, said tray comprising a divider panel cut out of said floor, said divider panel being oriented at a generally right angle relative to said floor, said divider panel functioning to retain one of said products separate from the other of said products.

30. A blank as set forth in claim 29, said divider panel comprising first and second panel sections foldably connected to said floor on the same fold axis, one of said panel sections being cut from said floor on one side of said fold axis and the other of said panel sections being cut from said floor on the opposite side of said fold axis, said fold panels being configured to overlap one another when oriented at a generally right angle relative to said floor.

31. A blank as set forth in claim 24, each side wall being of a continuous length and extending between opposed ends of said floor.

32. A blank as set forth in claim 17, said blank comprising at least one notch panel that depends beneath said floor, said one notch panel being foldably connected to said floor, said notch panel of an upper tray cooperating with one of said walls of a lower tray in order to aid in maintaining said upper and lower trays in stacked relation.

* * * * *